United States Patent [19]

Humm

[11] Patent Number: 4,781,322

[45] Date of Patent: Nov. 1, 1988

[54] KIT FOR DIRECT MAIL SOLICITATION

[75] Inventor: Lawrence F. Humm, Philadelphia, Pa.

[73] Assignee: Famous Artist Studios, Inc., Norristown, Pa.

[21] Appl. No.: 96,417

[22] Filed: Sep. 11, 1987

[51] Int. Cl.[4] ..... B65D 27/06

[52] U.S. Cl. ..... 229/73; 229/70; 229/71

[58] Field of Search ..... 229/73, 69, 70, 71

[56] References Cited

U.S. PATENT DOCUMENTS

| | | | |
|---|---|---|---|
| 3,380,648 | 4/1968 | De Lyra | 229/73 |
| 3,858,792 | 1/1975 | Volkert | 229/73 |
| 3,955,751 | 5/1976 | Mayne | 229/73 |
| 4,148,430 | 4/1979 | Drake | 229/73 |
| 4,351,474 | 9/1982 | Kaelblein et al. | 229/70 |
| 4,534,582 | 8/1985 | Howard | 206/610 |

OTHER PUBLICATIONS

L. F. Humm, "Label Program Synopsis", (Internal Memorandum), 1983–1986.

*Primary Examiner*—Willis Little

*Attorney, Agent, or Firm*—Seidel, Gonda, Goldhammer & Abbott

[57] ABSTRACT

The present invention is directed to a kit for direct mail solicitation. The kit includes a first envelope having a window, a second envelope having a window and an insert. The second envelope is sized for insertion into the first envelope. The insert is sized for insertion into the first envelope. The insert has a first and second portion which are integral. The first portion is defined by first and second sections. These sections are detachable from one another. The first section is sized for insertion into the second envelope after detachment from the second section. The first section comprises a non-releasable label having a first and second identification thereon. The first identification is located on the non-releasable label of the first section such that when the first section is inserted into the second envelope, the first indentification is in registry with the window of the second envelope. The second portion of the insert comprises a releasable label having the second identification thereon. The second identification is located on the releasable label such that when the insert is inserted into the first envelope, the second identification of the releasable label is in registry with the window of the first envelope.

12 Claims, 2 Drawing Sheets

KIT FOR DIRECT MAIL SOLICITATION

BACKGROUND OF THE INVENTION

Direct mail solicitation is well known. Many organizations use direct mail solicitation as a method of raising funds. Some direct mail solicitation campaigns include a bonus or premium with the request for funds as an additional inducement for the contribution. Such premiums have included return mail address labels, decorative stamps, pictures, or the like.

If the premium for the direct mail solicitation campaign is a return address label or other personalized item, then during the assembly of the direct mail solicitation kit, it was necessary to collate the proper personalized premium with the proper personalized letter and insert both these items along with any additional information into a properly addressed envelope or an envelope with a window. In the latter case it was necessary to correlate an address on a part of the inserted material with the window of the envelope. These operations are not only time consuming, but they are also difficult to handle logistically because they require the personalized premiums and letter to be assembled before insertion into the envelope. A problem with these operations is the likely possibility of inadvertently commingling the wrong personalized labels and letter.

With the advent of computerized mailing lists and computerized printing, it became possible to generate personalized solicitations, however, it does not solve the commingling problem.

The object of the present invention is to overcome the problem associated with the prior art, yet still have an inexpensive kit for direct mail solicitation.

SUMMARY OF THE INVENTION

The present invention is directed to a kit for direct mail solicitation. The kit includes a first envelope having a window, a second envelope having a window and an insert. The second envelope is sized for insertion into the first envelope. The insert is sized for insertion into the first envelope. The insert has a first and second portion which are integral. The first portion is defined by first and second sections. These sections are detachable from one another. The first section is sized for insertion into the second envelope after detachment from the second section. The first section comprises a non-releasable label means having a first and second identification means thereon. The first identification means is located on the non-releasable label means of the first section such that when the first section is inserted into the second envelope, the first identification means is in registry with the window of the second envelope. The second portion of the insert comprises a releasable label means having the second identification means thereon. The second identification means is located on the releasable label such that when the insert is inserted into first envelope, the second identification means of the releasable label is in registry with the window of the first envelope.

DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
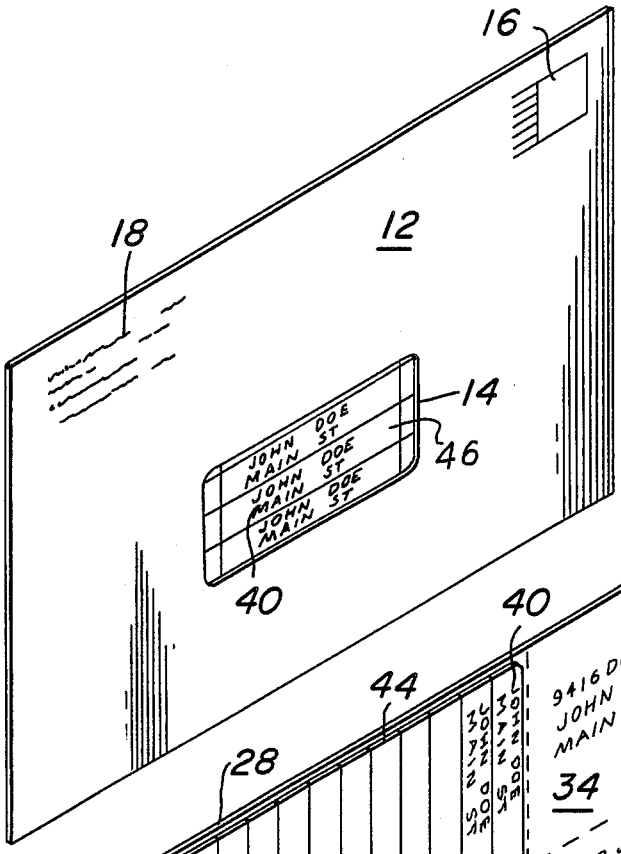
FIG. 1 is an isometric view of an assembled kit made according to the present invention.

Referring to the drawings wherein like numerals indicate like elements there is shown in FIG. 1 an assembled kit 10 made according to the present invention. A first envelope 12 has a window 14, preferably covered with a translucent material (not shown and well known in the art) and optionally has postage 16 and a return identification 18 thereon. A plurality of releasable units 46, each having a second identification means 40 (such as name and address of an individual), are visible through the window 14. These units 46 are described in greater detail below.

Figure 2:
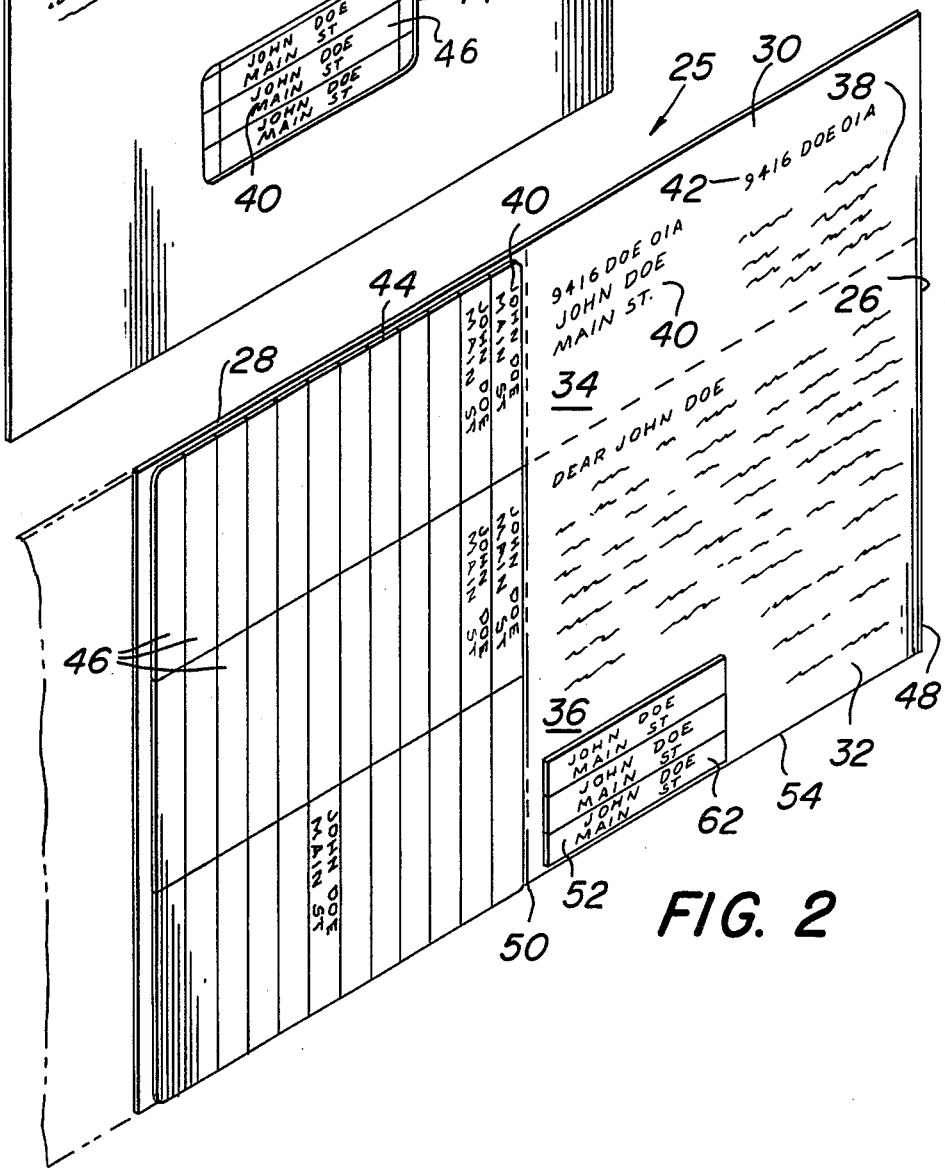
FIG. 2 is an isometric view of an insert made according to the present invention.

Referring to FIG. 2, there is shown an insert 25. Insert 25 includes a first portion 26 and a second portion 28 which are integral but are detachably joined together (described below. The integration of the first and second portion is a significant improvement over the prior art which required two sheets which had to be joined, e.g. by gluing. The integral first and second portion eliminates the need to join two separate sheets. Of course, there may be more than one second portion 28 and they would also be integral with the other portions. Each portion is sized for insertion into the first envelope 12. Preferably, each portion comprises a sheet 54, 56 which may have a release surface. Such surfaces are well known.

Figure 3:
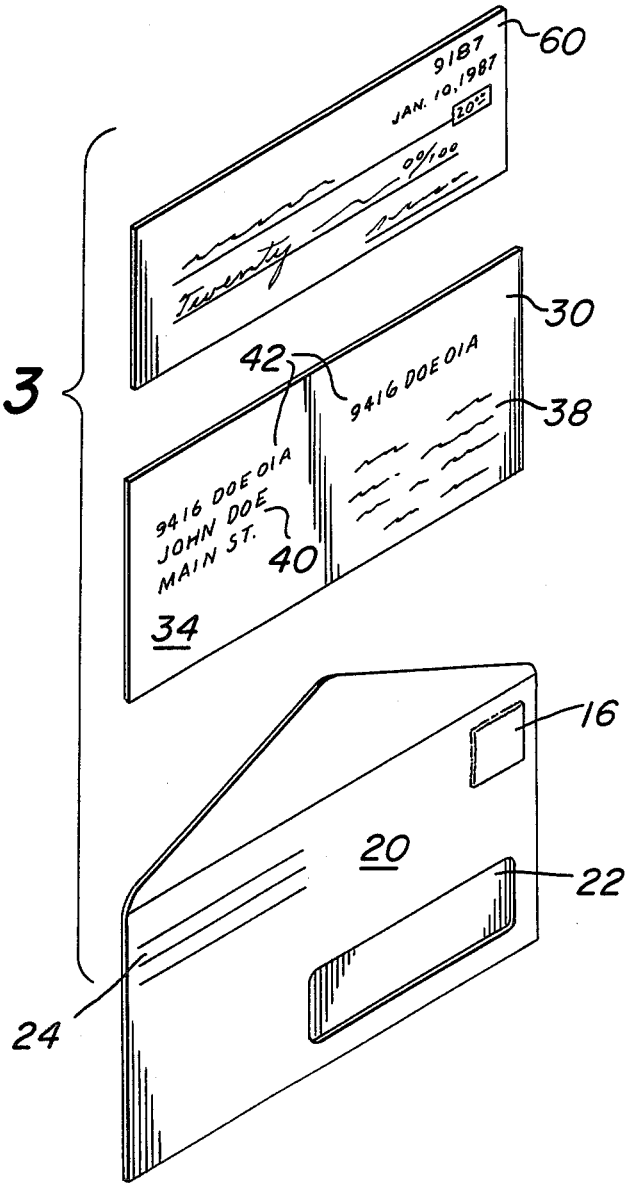
FIG. 3 is an exploded isometric view of a second envelope, a detached first section or "pledge card" and a negotiable medium.

First portion 26 is divided to a first section 30 and a second section 32. First section 30 is sized for insertion into a second envelope 20 and may be used as a "pledge card". See FIG. 3. Preferably, first section 30 includes a non-releasable label means 34 affixed to sheet 54. The adhesive necessary to bind label means 34 to first section 30 is well known to those of ordinary skill in the art. Alternately, a releaseable label means could be used, however it is not preferred because the edges of the releasable label means fold over and the adhesive backing sticks to the money or check inserted with the pledge card into envelope 20. This can cause the money or check to be destroyed upon its removal from the envelope 20.

Preferably, a first identification means 38 (the solicitor's name and address), a second identification means 40 (the addressee's name and address) and a third identification means 42 (a machine readable code) are printed on the label means 34. The first identification means 38 is placed on the label means 34 of the first section 30 such that when first section 30 is placed into second envelope 20, the first identification means is visible through a window 22 of the envelope 20. Machine readable code, such as those used for the third identification means 42, are well known to those of ordinary skill in the art.

The first and second sections 30, 32 are detachable from one another. Preferably, there is a frangible means which releasably connects the first and second sections 30 and 32. Preferably, this frangible means comprises a plurality of perforations 48 in a line.

Second section 32 of first portion 26 preferably comprises a non-releasable label means 36 affixed to sheet 54. The adhesive used to bind label means 36 to second section 32 is well known to those of ordinary skill in the art. Alternately, a releasable label means could be used and which is similar to the previously described releasable label however it is not preferred. Optionally, a portion of the label means 36 may include additional detachable units 62.

Label means 34, 36 preferably are a single label which is subsequently divided into parts corresponding in size to sections 30, 32.

The second portion 28 of the insert 25 has a releasable label means 44 affixed to sheet 56. The adhesive used on the releasable label means 44 is well known to those of ordinary skill in the art. Preferably, releasable label 44 is subdivided into a plurality of units 46. The second identification means 40 is printed onto each unit 46. Each unit 46 may then be used as a personalized return address label premium.

The first portion 26 is releasably connected to second portion 28 by a plurality of perforations 52 in a line which are disposed along a fold line 50. Second portion 28 may comprise more than one sheet of releasable units 46. Each additional second sheet would have corresponding label mean s44.

A second envelope 20 (see FIG. 3) includes a window 22, preferably covered by a translucent material (not shown) and optionally includes a return identification portion 24 and postage 16.

In use, envelope 12 is stuffed with second envelope 20 and then insert 25. Second portion 28 of insert 25 is placed into envelope 12 such that units 46 are visible through window 14.

After the addressee has received the solicitation kit 10, he detaches first portion 26 from second portion 28. Then, first section 34 of first portion 26 is detached from second section 36 of first portion 26. First section 34 is inserted into second envelope 20 such that the first identification means 38 is visible through window 22. Additionally, negotiable medium 60, such as a check or cash, is inserted into the envelope.

Since the preferred non-releasable label means 34 affixed to first section 30 cannot be removed from the sheet it will not adhere to the negotiable medium 60. Thus, the medium 60 cannot be destroyed.

The present invention may be embodied in other specific forms without departing from the spirit or essential attributes thereof and, accordingly, reference should be made to the appended claims, rather than to the foregoing specification, as indicating the scope of their invention.

I claim:

1. A kit for direct mail solicitation comprises:

(a) a first envelope having a window;

(b) a second envelope having a window, said second envelope being sized for insertion into said first envelope; and (c) an insert being sized for insertion into said first envelope and having a first portion and a second portion which are integral, (i) said first portion having first and second sections, said sections being detachable from one another, said first section being sized for insertion into said second envelope after detachment from said second section, said first section comprising a non-releasable label means having a first identification means and a second identification means thereon, said first identification means being located on said non-releasable label means of said first section such that when said first section is inserted into said second envelope, said first identification means is in registry with said window of said second envelope, (ii) said second portion comprising a releasable label means having said second identification means thereon, said second identification means being located on said releasable label means such that when said insert is inserted into said first envelope said second identification means of said releasable label means is in registry with said window of the first envelope.

2. The kit according to claim 1 wherein a frangible means separates said first and second sections.

3. The kit according to claim 2 wherein said frangible means comprises a plurality of perforations in a line.

4. The kit according to claim 1 wherein said nonreleasable label means of said first section further comprises a third identification means.

5. The kit according to claim 4 wherein said third identification means comprises a machine readable code.

6. The kit according to claim 1 wherein said releasable label means of said second portion comprises a plurality of detachable units, each unit having said second identification means thereon.

7. The kit according to claim 1 wherein said second portion comprises one or more sheets.

8. The kit according to claim 1 wherein said first portion comprises a sheet and said second portion comprises a sheet, said first and second portion sheets being joined at a fold line.

9. The kit according to claim 8 wherein said fold line comprises a fold line frangible means.

10. The kit according to claim 9 wherein said fold line frangible means comprises a plurality of perforations in a line.

11. A kit for direct mail solicitation comprises:

(a) a first envelope having a window;

(b) a second envelope having a window, said second envelope being sized for insertion into said first envelope; and (c) an insert being sized for insertion into said first envelope and having a first portion and a second portion which are integral, each said portion comprising a sheet, (i) said first portion further comprising first and second sections, said sections being detachable from one another via a plurality of perforations in a line, said first section being sized for insertion into said second envelope after detachment from said second section, said first section additionally comprising a non-releasable label means having a first identification means and a second identification means thereon, said first identification means being located on said non-releasable label means of said first section such that when said first section is inserted into said second envelope, said first identification means is in registry with said window of said second envelope, (ii) said second portion additionally comprising a plurality of releasable label means each having said second identification means thereon, said second identification means being located on said releasable label means such that when said insert is inserted into said first envelope said second identification means of said releasable label means is in registry with said window of the first envelope.

12. A kit for direct mail solicitation comprises:

(a) a first envelope having a window;

(b) a second envelope having a window, said second envelope being sized for insertion into said first envelope; and (c) an insert being sized for insertion into said first envelope and having a first portion and a second portion which are integral, (i) said first portion having first and second sections, said sections being detachable from one another, said first section being sized for insertion into said second envelope after detachment from said second section, said first section comprising a releasable label means having a first identification means and a second identification means thereon, said first identification means being located on said releasable label means of said first section such that when said first section is inserted into said second envelope, said first identification means is in registry with said window of said second envelope, (ii) said second portion comprising a releasable label means having said second identification means thereon, said second identification means being located on said releasable label means such that when said insert is inserted into said first envelope said second identification means of said releasable label means is in registry with said window of the first envelope, said releasable label means of said second portion comprises a plurality of detachable units, each unit having said second identification means thereon.

* * * * *